US005366333A

United States Patent [19]

Crudo et al.

[11] Patent Number: 5,366,333

[45] Date of Patent: Nov. 22, 1994

[54] MOTORIZED BINDING MACHINE

[75] Inventors: Phillip M. Crudo; Luis de Leon, both of Sparks, Nev.

[73] Assignee: Velo-Bind, Inc., Sparks, Nev.

[21] Appl. No.: 943,734

[22] Filed: Sep. 11, 1992

[51] Int. Cl.[5] ..... B42B 5/08

[52] U.S. Cl. ..... 412/16; 412/11; 412/43

[58] Field of Search ..... 412/11, 13, 16, 43

[56] References Cited

U.S. PATENT DOCUMENTS

| | | | |
|---|---|---|---|
| 3,811,146 | 5/1974 | Abildgaard et al. | 11/1 R |
| 3,994,035 | 11/1976 | Elder et al. | 11/1 R |
| 4,068,997 | 1/1978 | Elder et al. | 425/305.1 |
| 4,270,970 | 6/1981 | Szanto et al. | 156/498 |
| 4,293,366 | 10/1981 | Szanto et al. | 412/43 X |
| 4,442,743 | 4/1984 | Szanto | 412/43 X |
| 5,015,138 | 5/1991 | Crudo et al. | 412/43 |

FOREIGN PATENT DOCUMENTS 48746 5/1974 Australia .

*Primary Examiner*—Mark Rosenbaum
*Assistant Examiner*—S. Thomas Hughes
*Attorney, Agent, or Firm*—Julian Caplan

[57] ABSTRACT

Plastic binding strips, one strip having studs which fit through holes in sheets to be bound, the other strip having holes to receive the studs are bound in a machine which compresses the strips toward each other, then cuts of excess stud length and forms rivet heads on the stud ends to bind the strips together. The present improvement over such machines uses a motor to drive linkages previously manually actuated. The binding motor drives linkages on either side of the machine which cause a transverse pressure bar to apply a preselected compressive force on the strips, then to initiate the movement of the knives which cut off the studs and form heads thereon and finally release the compressive force. The cutting and head forming functions are performed by springs which pull a transverse rod rearward of the machine to push rearward a support for the knives. A second motor drives a linkage which returns the pressure bar to its upward position as the binding cycle is completed.

12 Claims, 7 Drawing Sheets

MOTORIZED BINDING MACHINE

BACKGROUND OF THE INVENTION

1. Field of the Invention

This invention relates to a new and improved book binding machine of the type using a pair of plastic binding strips, the first strip having studs spaced along the length of the strip and the other strip having holes spaced complementary to the studs. The second strip is installed in the machine, punched sheets are aligned with the second strip, the studs of the first strip are inserted through holes in the sheets and in the second strip and the machine then compresses the strips toward each other, cuts off excess stud length and forms rivet heads on the studs to bind the book together. Thus the present invention comprises an improvement over U.S. Pat. Nos. 3,994,035 and 4,068,997 which employ many of the mechanical elements of the present invention.

2. Description of the Related Art

Although U.S. Pat. Nos. 3,994,035 and 4,068,997 were manually operated machines, nevertheless motor driven machines are shown in such prior U.S. Pat Nos. as 4,270,970 and 3,811,146. However, the mechanisms used in accordance with the present invention are considerably simpler and less expensive than those heretofore used with motorized binding machines.

Means for returning a pressure bar to its upward position at the end of a binding cycle are shown in U.S. Pat. No. 4,270,970. The present invention employs a different mechanism for such return which is energized by a separate motor.

SUMMARY OF INVENTION

The present machine is a development of U.S. Pat. No. 3,994,035. Details of the mechanisms common to the present machine and the aforesaid patents are readily apparent. At the commencement of a cycle of operation of the present machine, the operator inserts the binding strips and sheets and manually positions a pressure bar on top of the uppermost of the plastic binding strips. Closing a switch initiates one cycle of operation of the binding motor. As in the prior machines, a punching mechanism is installed. Such a punching mechanism may be used in the present invention. Details thereof are substantially the same as that shown in the prior patents. The important distinction over the prior patents is that the punching mechanism is driven by a crank turned by the shaft of the binding motor.

In the binding mode of the machine, if the pressure bar has been removed from its upward or retracted position, energization of the binding motor accomplishes the binding operation by means of an interlock.

Rotation of the binding motor causes oscillation of cranks which cause generally longitudinal rearward movement of actuators on either side of the machine. The actuators perform several functions, one of which is to turn a crank which pulls the pressure bar downwardly. Such movement is further implemented by a pawl engaging rachet teeth on a segment which turns with the crank. A spring is compressed until a certain spring force is attained, whereupon downward force on the pressure bar is terminated.

A second interlock restrains movement of a support for the heated cutting knives which permits springs on either sides of the machine to pull a knife support rearward. The springs are connected to a transverse rod which bears against the support. When the knife support reaches the limit of its rearward movement, the springs continue to apply a force thereto. By reason of the manner in which the knife support is mounted, the continued biasing effect of the springs causes the support to rise, thereby causing the knives to form heads on the cut-off stubs of the studs. The structure of the knives is similar to that in the preceding patents. They are electrically heated by a current flowing therethrough controlled to continue only on the rearward movement of the knives.

Continued turning of the bind motor causes the actuators on either side of the machine to move rearward, and such movement causes the second interlock to return the knife support to first move downwardly and then move rearwardly to its initial retracted position.

Further turning of the drive motor closes a switch which energizes a pressure bar return motor. Such motor lifts the pressure bar to its retracted position at the conclusion of the binding cycle.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
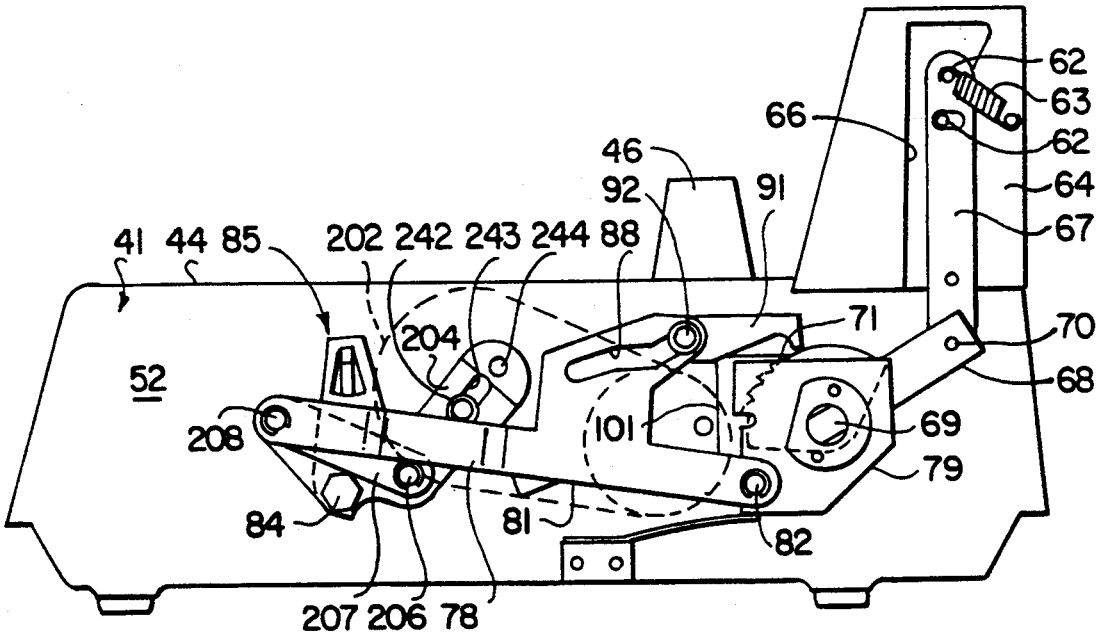
FIG. 1 is a side elevational view of the apparatus of the present invention with the casing removed.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

As has been stated, the present invention comprises an improvement over U.S. Pat. No. 3,994,035. In many instances, the description of a preferred embodiment which follows resembles the description in the foregoing patent and, in many instances, the same reference numerals are used to describe corresponding parts. Further details of the present invention will be apparent upon reading the aforesaid patent.

The present invention is for use with first thermoplastic strip 21, which is rectangular in cross section and has spaced at intervals along its length depending from one face thereof studs formed with points 23 at their lower ends. Strip 21 as well as second strip 24 is preferably formed of a thermo-plastic material such as polyvinyl chloride. Second strip 24 is also rectangular in cross section and is of the same length as strip 21, which is preferably the length of the book to be bound. At intervals complementary to the studs are first apertures (not shown) in strip 24 through which the studs extend. The sheets 28 to be bound are formed with second apertures adjacent one marginal edge, the spacing between apertures being the same as that between the second the studs and first apertures.

Operation of the apparatus, hereinafter described, applies a downward pressure on the top of first strip 21, the studs of which have been inserted through the second apertures in the sheets and first apertures in the strip 24 so that there are projecting portions 31 of the studs, the extent of projection depending upon the thickness of the sheets 28. The apparatus cuts the projecting portions 31 at a level slightly below the bottom of strip 24, leaving short stubs which are melted by a knife and moved to form heads (not shown) as well as understood in the bookbinding art. After the heads have cooled sufficiently, the pressure against the first strip 21 is removed and a completed book has been produced. The foregoing description of the strips, sheets and method are similar to that of the operation and supplies used with U.S. Pat. No. 3,994,035 as well as other patents of the same assignee.

The apparatus of the present invention has a casing 41 (shown only partially) preferably molded of plastic material. Provision is made for punching holes in sheets 28, but the details of the punching mechanism and operation thereof are substantially identical to that shown in U.S. Pat No. 3,994,035 and hence are not herein described in detail. Casing 41 has a top 44 which also functions as a platen, as hereinafter explained. Binding edge guide 46 on platen 44 is adjustably positioned to be engaged by one side edge of sheets 28. Extending along either side of the machine inside the sides of casing 41 are vertical side plates 52 suitably spaced apart and rigidly interconnected by mounting means 55 and other means not shown. Extending between the side plates 52 is binding platen 44. Platen 44 is formed with a transversely extending shallow recess 56 to receive second strip 27 (see FIG. 8) and there is an opening 57 below recess 56 through which project the portions 31 of the studs below strip 24. A substantially vertical rear edge stop 58 for the rear edges of sheets 28 supported on platen 44 squares said edges with the rear edge of strip 24 when the latter is in recess 56.

Side posts 64 extend up above the level of platen 44 adjacent the rear of each side of the machine. Extending between the posts 64 is a transverse pressure bar 61 which applies downward pressure on strip 21. At each end of pressure bar 61 are pins 62, the upper pin 62 fitting into a horizontal slot 65 in the inward facing surfaces of post 64 and then being moved into an elongated vertical slot 66 in the inward faces of side posts 64. The lower pin 62 remains in slot 66. When the upper pin 62 is in horizontal slot 63 and pulled rearwardly thereof by spring 63, pressure bar 61 is retracted from its operative position and is tilted upward-rearwardly out of the way of the insertion of sheets 28 and first strip 21. When the bar 61 is moved manually forwardly and downwardly, the pins 62 slide in vertical slot 66. Lower pin 62 is pivotally connected to the upper end of link 67 which extends below platen 44 and lies immediately outside plate 52. The lower end of link 67 is pivotally connected by means of pin 70 to crank arm 68, the opposite end of which oscillates with horizontal transverse shaft 69 as hereinafter appears. Also oscillating with shaft 69 is a segment 71 formed with a ratchet. Plate 52 is formed with an arcuate slot 72 concentric with shaft 69 and pin 73 in crank arm 68 oscillates in slot 72.

In the aforementioned U.S. Pat. No. 3,994,035 actuation of the punching mechanism and of the binding mechanism is accomplished by manually moving a handle attached to an extension of shaft 69. In the present invention, however, the binding mechanism as well as the punch mechanism are motor driven. Accordingly motor 201 is suitably mounted within casing 41 and is preferably mounted preferably supported by one of the side plates 52. A gear reduction 202 driven by motor 201 is connected to horizontal transverse shaft 203 mounted in plates 52. On either side of the machine on the exterior of plates 52 is a crank cheek 241 having an eccentric crank pin 242 which fits into an elongated slot 243 in crank 204. Crank 204 is pivoted to plate 52 by means of pivot 244.

Pivotal movement of crank 204 is transmitted through pivot 206 on the outer end of crank 204 opposite pivot 244 to link 207, the farther end of which is connected by pivot 208 to the forward end of horizontally elongated link 81 first by any suitable means. Link 81 is formed with an offset 78 to clear the end of shaft 203 and crank 204 and the supports therefor. The rearward end of link 81 is connected by pivot 82 to an irregularly shaped crank 79 affixed to shaft 69 to cause oscillation thereof in one direction. Pivot 208 also connects link 207 to punch crank 83 and the latter is connected by pivot 84 to the punch mechanism 85 which is not described in detail. Further particulars of the punch are set forth in U.S. Pat. No. 4,079,647.

Figure 2A:
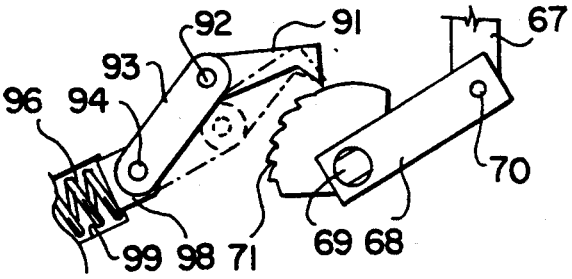
FIG. 2A is a fragmentary, side elevation view of a portion of the structure of FIGS. 1 and 2.
Figure 2:
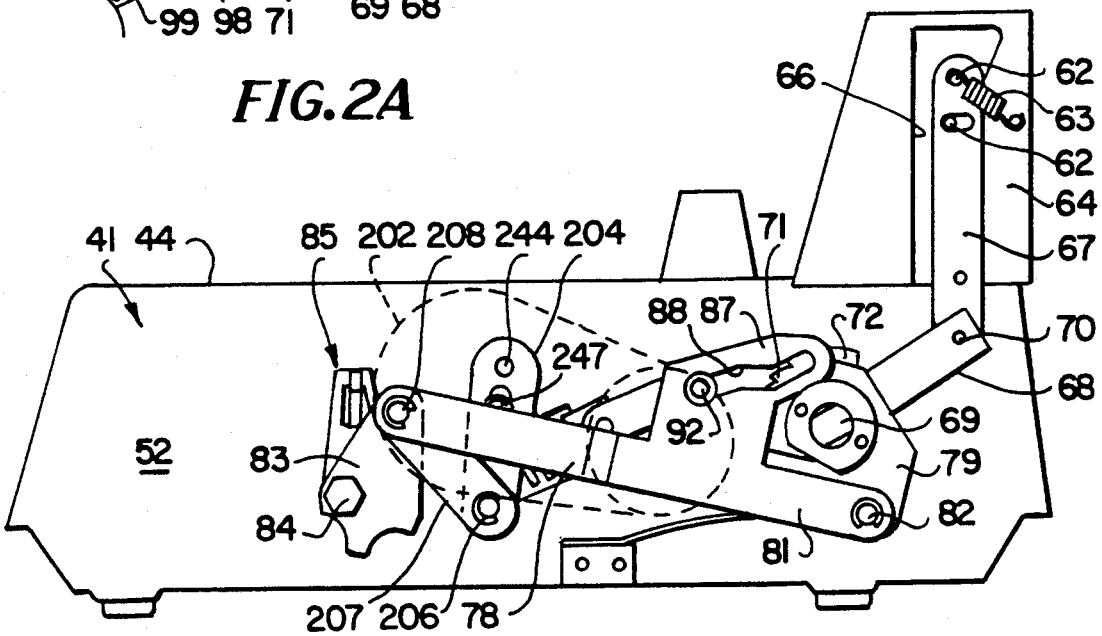
FIG. 2 is a view similar to FIG. 1 showing the apparatus at a different position in its cycle of operation.
Figure 11:
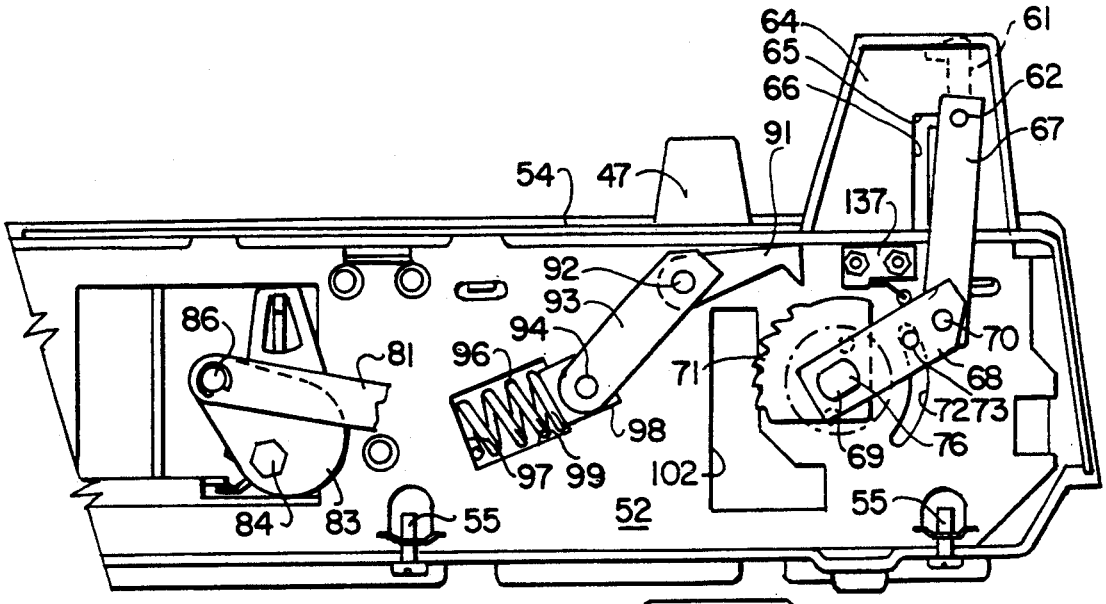
FIG. 11 is a side elevational view similar to FIG. 1 with parts removed to reveal internal construction.
Figure 12:
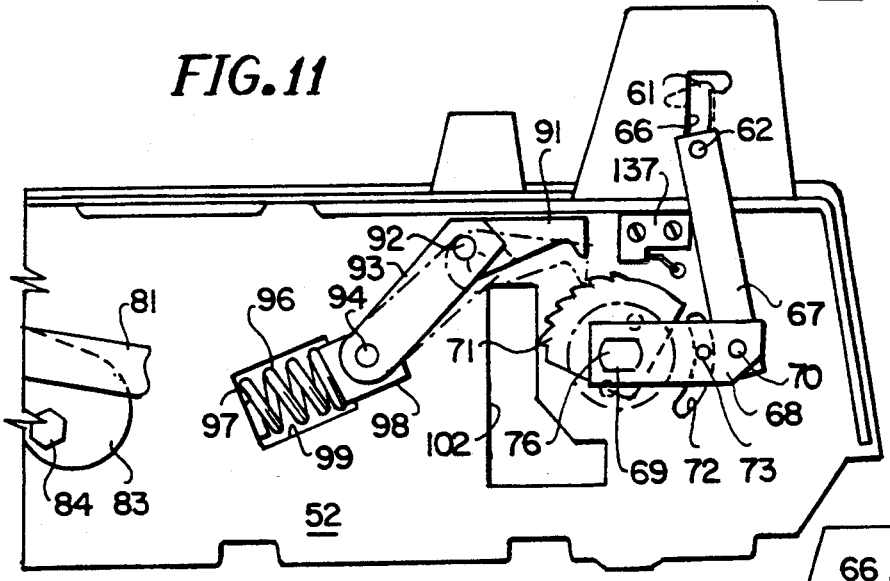
FIG. 12 is a fragmentary view of a portion of the structure of FIG. 11 with the parts at a different position in the cycle of operation of the machine.
Figure 13:
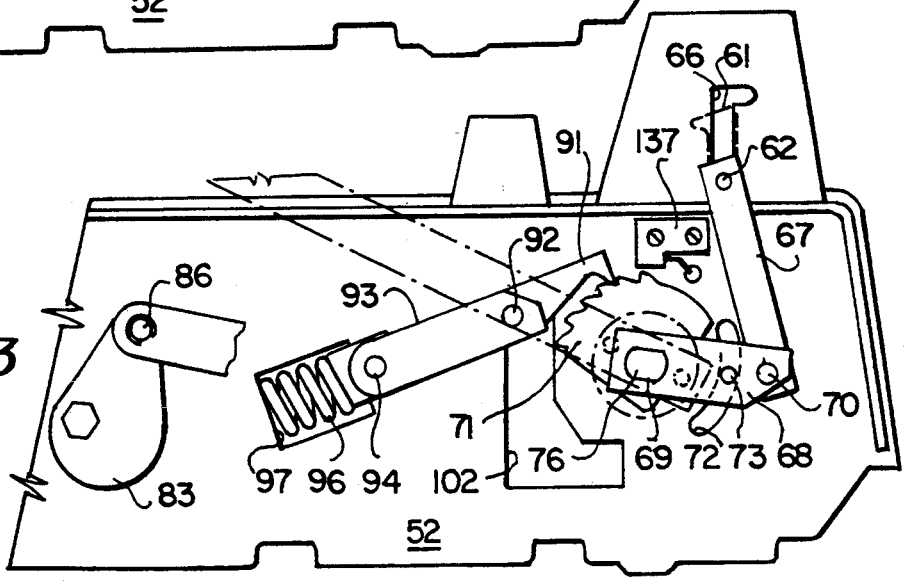
FIG. 13 is a view similar to FIG. 12 showing the parts in still another position in the cycle of operation of the machine.

Link 81 is formed with an upward rearward extension 87 formed with a slot 88 in which pivot pin 92 slides. Pivot 92 also mounts pawl 91 and link 93. The forward end of link 93 is connected by pin 94 to fitting 98 against which bears the rearward end of compression spring 96. Spring 96 fits in an aperture 99 in plate 52. If pressure bar 61 has been moved forwardly and downwardly so that ratchet segment 71 is partially turned from the position of FIG. 11 to the position of FIG. 12, as link 81 is moved rearwardly by motor 201 from the position of FIG. 1 to the position of FIG. 2, pin 92 slides from its up position in slot 88 in FIG. 1 to the down position of FIG. 2 causing the pawl 91 to move from the position of FIG. 11 to the position of FIG. 13 which turns the ratchet 71 in a clockwise direction as viewed in FIG. 13 until the spring 96 compresses under a predetermined application of force, whereupon movement of pawl 91 terminates. As the ratchet segment 71 is turned clockwise by the pawl 91, crank 68 exerts a downward pressure on link 67 and thus on pressure bar 61 so that a predetermined compressive force is applied by the pressure bar 61 on first strip 21. By reason of the shape of slot 88, when pin 92 enters the middle of slot 88 link 93 moves clockwise and pawl 91 becomes practically aligned therewith. Therefore the upward pressure exerted on pressure bar 61 by reason of the compression of sheets below pressure bar 61 does not return the parts to initial position. As best shown in FIGS. 2 and 13, when the pawl 91 is exerting turning force on segment 71, pins 92, 94 and pawl 91 are almost in a straight line. Pin 92 bears against the top edge of the middle of slot 88 and segment 71 is locked in place. Slot 88 is long enough to permit full cycling of motor shaft 203.

Spring 96 functions as an overload mechanism, retaining fitting 98 and pivot pin 94 in a fixed position until such time as the resistance of compressed strips 21 and 24 with interposed sheets 28 forces spring 96 to begin to compress, allowing fitting 98 and pin 94 to move within aperture 99 in plate 52, preventing overcompression of the bound book or damage to the machine. Spring 96 also functions to insure a predetermined pressure being applied to the book while it is being made. Spring 96 also accommodates variations in operator technique of inserting strips and lowering the pressure bar. Still further, spring 96 accommodates different kinds of paper which may be used and particularly the effect of air between the sheets, which varies with different types of paper. When the binding operation is completed, motor 201 returns link 81 to its forward position shown in FIG. 1. The pressure bar 61 is raised (as hereinafter described) because the return of link 81 to forward position disengages pawl 91 from ratchet segment 71.

Figure 4:
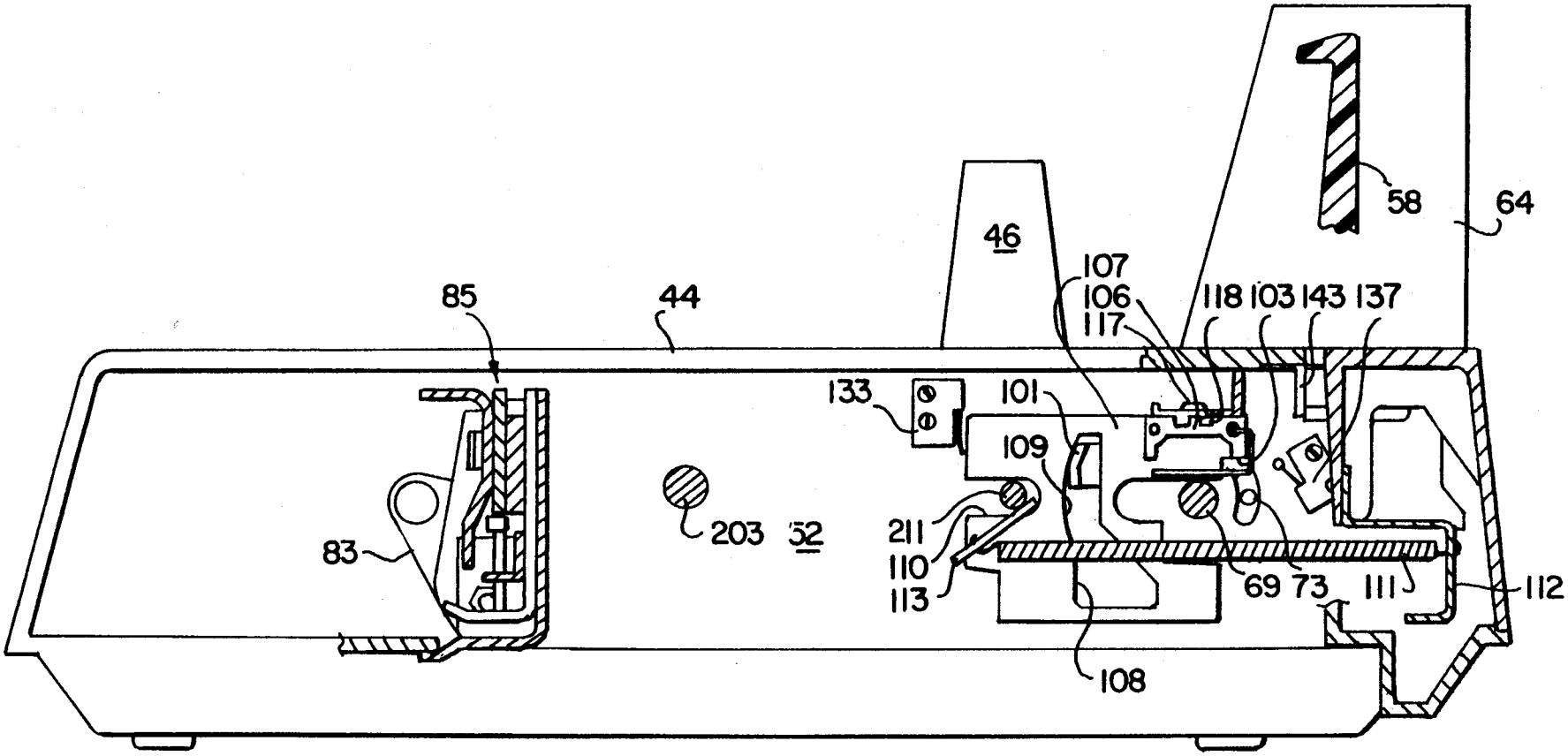
FIG. 4 is a sectional view taken substantially along the line 4—4 of FIG. 3.
Figure 7:
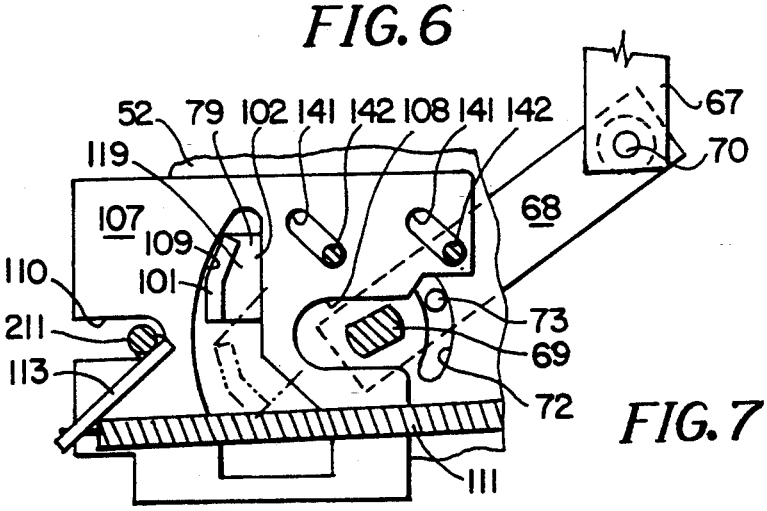
FIG. 7 is a sectional view taken substantially along the line 7—7 of FIG. 10.

Mounted for horizontal reciprocation between side plates 52 and below the level of platen 44 is horizontal transverse knife support 106, the ends of which are connected to vertical drive plates 107 which reciprocate immediately within plates 52. Horizontally elongated slot 108 is formed in plate 107 for passage of shaft 69 so that plates 107 and support 106 may reciprocate above the level of shaft 69. Further, horizontally elongated slot 110 is formed in the forward edge of plate 107 to receive transverse rod 211 (see FIG. 7) so as to retain plate 107 in close sliding contact with plate 52 and horizontal plate 107 is also formed with a slot 108 having a cam surface 109 which is non-circular relative to shaft 69. Lobe 101 on crank 79 fits into an enlarged opening 102 in plate 52. Lobe 101 projecting through plate 52 fits into the opening 108 in plate 107 and at the upper end of its movement bears against surface 109 to prevent movement of plate 107. Lobe 101 also functions to retract plate 107 to initial position by moving plate 107 and support 106 to the left as viewed in FIG. 4. As link 81 is pulled forward, lobe 101 moves downward out of contact with the surface 109 (see dotted line position in FIG. 7). Horizontal tension springs 111 are fastened at their rear to a rear stationary anchor 112 interconnecting opposite plates 52 and at their forward ends are fastened to ears 113 on opposite ends of transverse rod 211. The inside surface of drive plates 107 and the ends of ears 113 bear against the insides of side plates 52. Offset 212 on rod 211 clears motor 201. Use of transverse rod 211 insures that both sides of knife support 116 move equally simultaneously. Plates 107 on either side of the machine are biased rearwardly by a spring 111 from the knife retraction position shown in FIG. 4 to the cutting position and this movement is permitted when the lobe 101 is in down position. After the cutting and head forming operation, lobe 101 engages surface 109 as link 81 approaches retracted position and moves plates 107 and hence knife support 106 to the left as viewed in FIG. 4.

Figure 5:
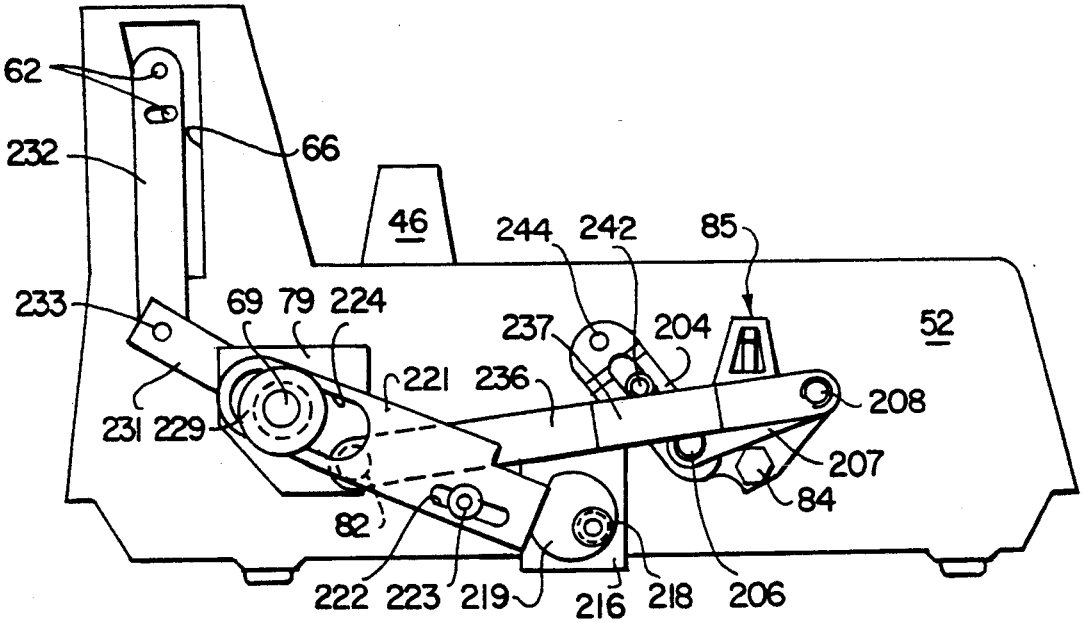
FIG. 5 is a view similar to FIG. 1 taken from the opposite side of the machine.

Plate 107 at its right-hand end immediately above slot 108 is formed with a shoulder 103. When pin 73 is elevated (i.e. in the position shown in FIGS. 7 and 8), it engages shoulder 103 and prevents movement of plate 107 to the right. Hence, when the pressure bar 61 is elevated and is pushed rearwardly (i.e. when there is no binding function to be performed), pin 73 prevents movement of plate 107 despite the oscillation of crank 79 and the fact that lobe 101 is not an engagement with cam surface 109. As shown in FIG. 5, with pin 73 out of engagement with shoulder 103 there is no obstacle to movement of support 106 to the right so that the knife 122 may perform its cutting function.

Above knife support 106 is a removable knife support 116 which may be replaced when the knife hereinafter described has been damaged. The removable support 116 is connected to support 106 by screws 117 which holds support 116. By removing screws, it allows removal of support 116 and the parts assembled thereto.

Figure 8:
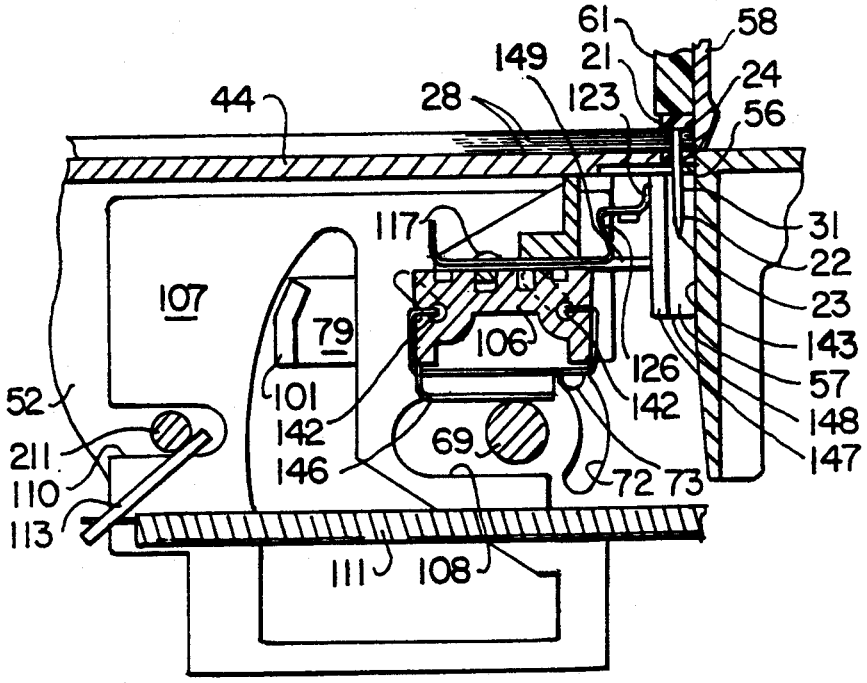
FIG. 8 is a fragmentary sectional view taken substantially along the line 8—8 of FIG. 10.
Figure 9:
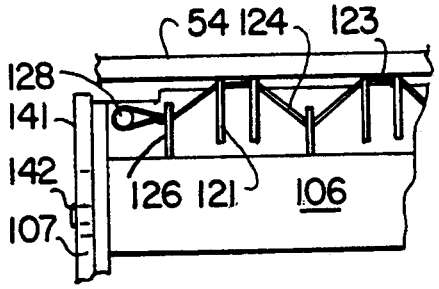
FIG. 9 is a fragmentary plan view of a portion of the structure of FIG. 10 as viewed from the right.
Figure 10:
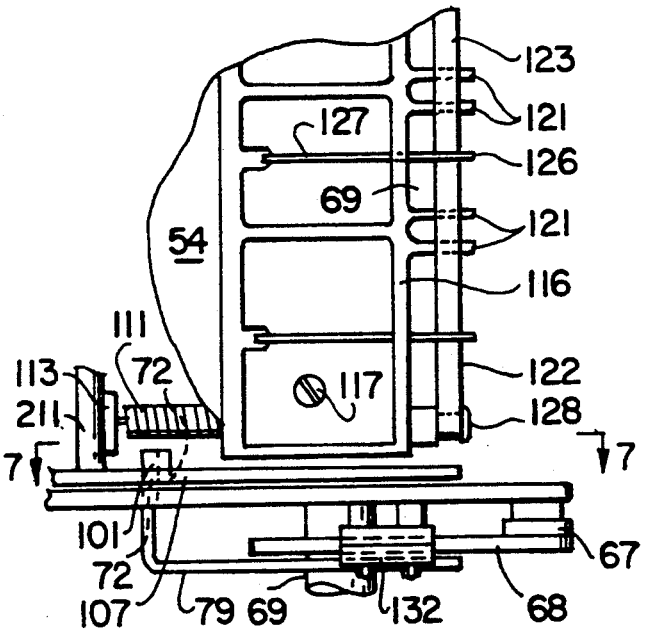
FIG. 10 is a fragmentary plan view of a portion of the knife and surrounding structure.

Removable support 116, as best shown in FIG. 10 and 9, at its rearward end has spaced vertical ribbon supports 121 which support knife 122. As has been mentioned, knife 122 is a continuous ribbon of spring steel preferably plated with a non-corrosive metal such as nickel and then coated with Teflon so that the plastic stud 31 material does not cling thereto. A horizontal stretch 123 of ribbon 122 is tightly stretched between each pair of supports 121 and the spacing of horizontal stretches 123 coincides with the position of the stud material 31. Between horizontal stretches 123 and thus between the pairs of supports 121, the ribbon 122 slants downward in angular stretches 124 meeting at a point where they are engaged by hold down springs 126, which are irregularly shaped members as best shown in FIG. 8, and slide in grooves 127 on the underside of portion 118 of removable support 116. Thus the springs 126 tension the ribbon 122 and cause the horizontal portion 123 to be stretched taut between the supports 121 so as to perform the cutting and heading function. The ends of ribbon 122 are bent around the end posts 128 at opposite ends of support 116.

Drive plate 107 is provided with a pair of upwardly-rearwardly slanted slots 141. The opposite ends of support 106 are provided with a pair of pins 142 which fit into slots 141. When support 106 is moved to the full right position, it engages a stationary abutment 143 affixed to the frame of the machine. It will be noted that the underside of platen 44 is formed with an undercut 144 immediately to the left of recess 56. As springs 111 pull the support 106 to the right, when the support 106 engages abutment 143, further spring tension causes pins 142 to move upwardly in slots 141. A spring 146 depending from support 106 and resiliently engaging the top of shaft 69 biases support 106 upwardly.

Integral with and depending from housing 54 and in horizontal alignment with a straight stretches 123 of knife 122 are vertical ribs 147, the lower ends of which are supported by supports 148 which are joined to abutment 143. The first time the knife is actuated, hot horizontal stretches 123 cut horizontal slots 149 in ribs 147, the vertical height of said slots being about equal to the thickness of material of stretches 123. Thereafter each time the hot knife is actuated it moves rearwardly through the slots 149 and when it retracts the margins of slots 149 wipe from stretches 123 any plastic material which has adhered thereto when the studs 31 were cut.

Figure 3:
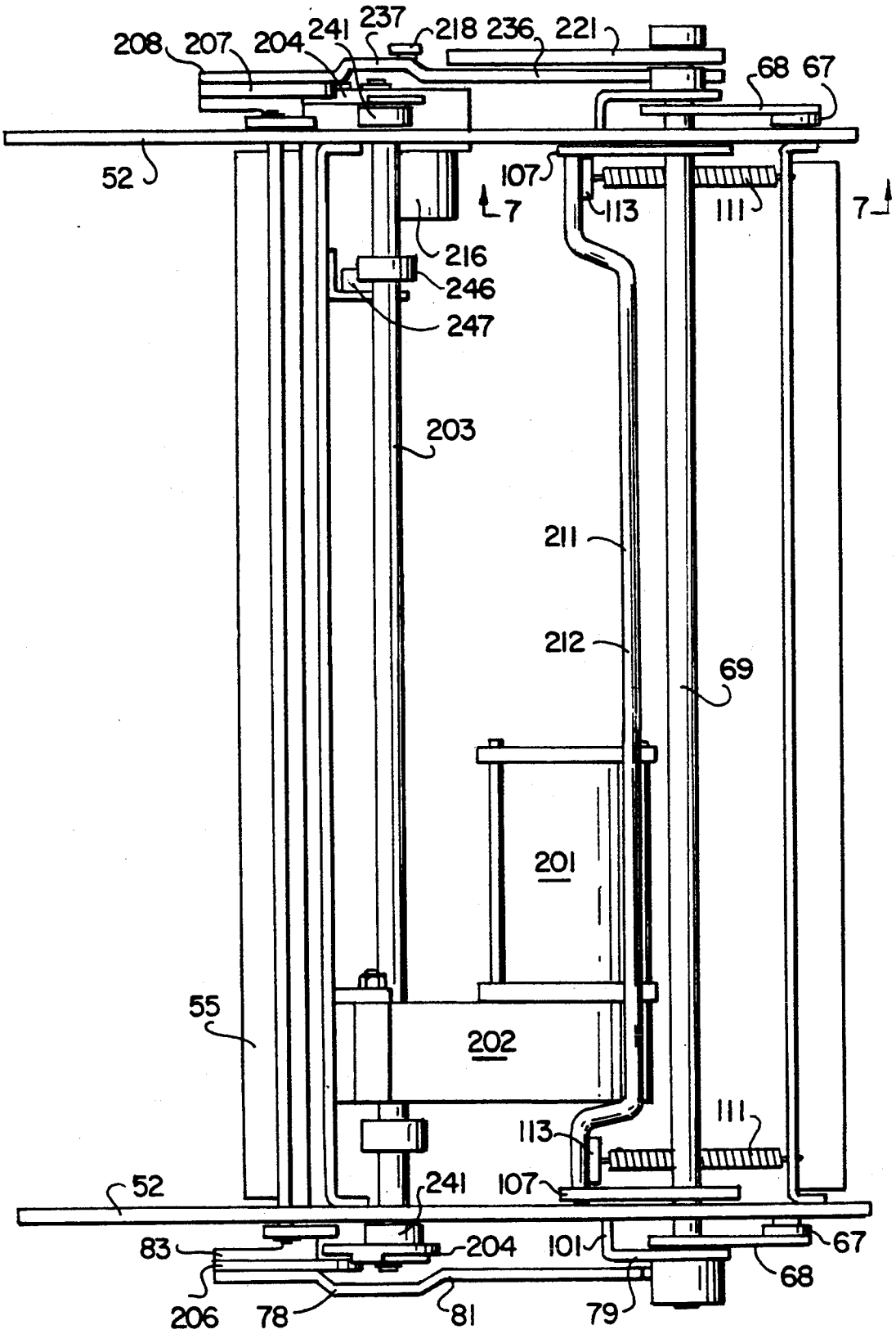
FIG. 3 is a top plan view with the platen and casing and other elements of the machine removed.
Figure 6:
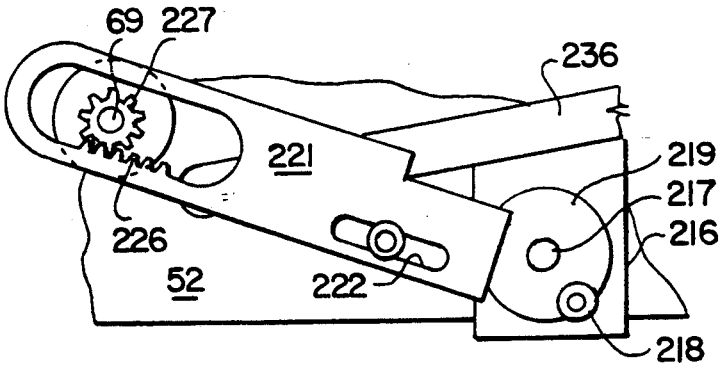
FIG. 6 is a partial side elevational view of a portion of the structure of FIG. 5 with parts removed.

On the left side of the machine as viewed on FIGS. 3, 5 and 6, provision is made for returning pressure bar 61 to up position at the conclusion of the cycle of motor shaft 203. Shaft 203 carries crank cheek 241 on which is eccentric crank pin 242 in crank 204 pivoted at its upper end to plate 52. As best shown in FIG. 5, pin 242 oscillates crank 204 which is connected by pivot pin 206 to the forward end of link 207. Link 207 is connected by pivot 208 to the forward end of rearwardly extending connecting link 236 which functions to move shaft 82 in the same manner as shaft 82 on the right-hand side of the machine. More specifically, link 236 causes oscillation of crank 79 which is affixed to the left end of shaft 69. The foregoing elements of the mechanism insure that the punch mechanism 85 and shaft 69 are turned equally on both sides of the machine.

Return motor 216 is mounted within the plate 52 on the left side of the machine. Motor shaft 217 turns cam cheek 219 which carries eccentric cam 218 adjacent its outer edge.

Slidable parallel to plate 52 is cam follower lever 221 formed with slot 222. Adjacent the rearward end of lever 221 is a second elongated slot 224. The lower edge of slot 224 is formed with rack teeth 226 engaged by pinion 227 mounted on shaft 69. Retainer 229 affixed to shaft 69 cooperates with stud and clip 223 to hold lever 221 parallel to plate 52. Affixed to shaft 69 is crank 231 which is pivoted by pivot 233 to the lower end of link 232, which functions similar to link 67 on the opposite side of the machine.

Link 232 is raised at the end of the cycle of motor 201 by energization of return motor 216. Motor 216 causes rotation of cheek 219 which brings cam 218 in contact with the end of cam-follower lever 221, moving the latter to the left as viewed in FIGS. 5 and 6. The rack teeth 226 meshing with pinon 227 cause shaft 69 to rotate crank 231 upwardly, raising the link 231 which is attached by pin 62 to pressure bar 61.

BINDING OPERATION

The binding operation is as follows:

The operator manually inserts strip 24 in recess 56. A plurality of sheets 28, suitably formed with holes (which either have been punched in the punch mechanism 85 or elsewhere) is placed over strip 24, one edge of the sheets being in contact with edge guide 46 and another with stop 58. Thereupon the studs of strip 21 are inserted through holes in sheets 28 and through holes in strip 24. The position of the parts is then essentially as shown in FIG. 8. Thereupon, the operator pulls pressure bar 61 forwardly and downwardly from the position of FIG. 11 to the position of FIG. 12 so that the pressure bar rests on the top of strip 21 and partially compresses sheets 28. At the same time, lowering of link 67 causes the shaft 69 to rotate and brings the lever 221 downward until its lower end rests against the cam roller 218. Bringing the pressure bar 61 downward closes switch 137 and segment 71 moves to the position of FIG. 12. Pin 73 moves out of contact with knife support 106 (contrast FIG. 8 with FIG. 4).

Figure 14:
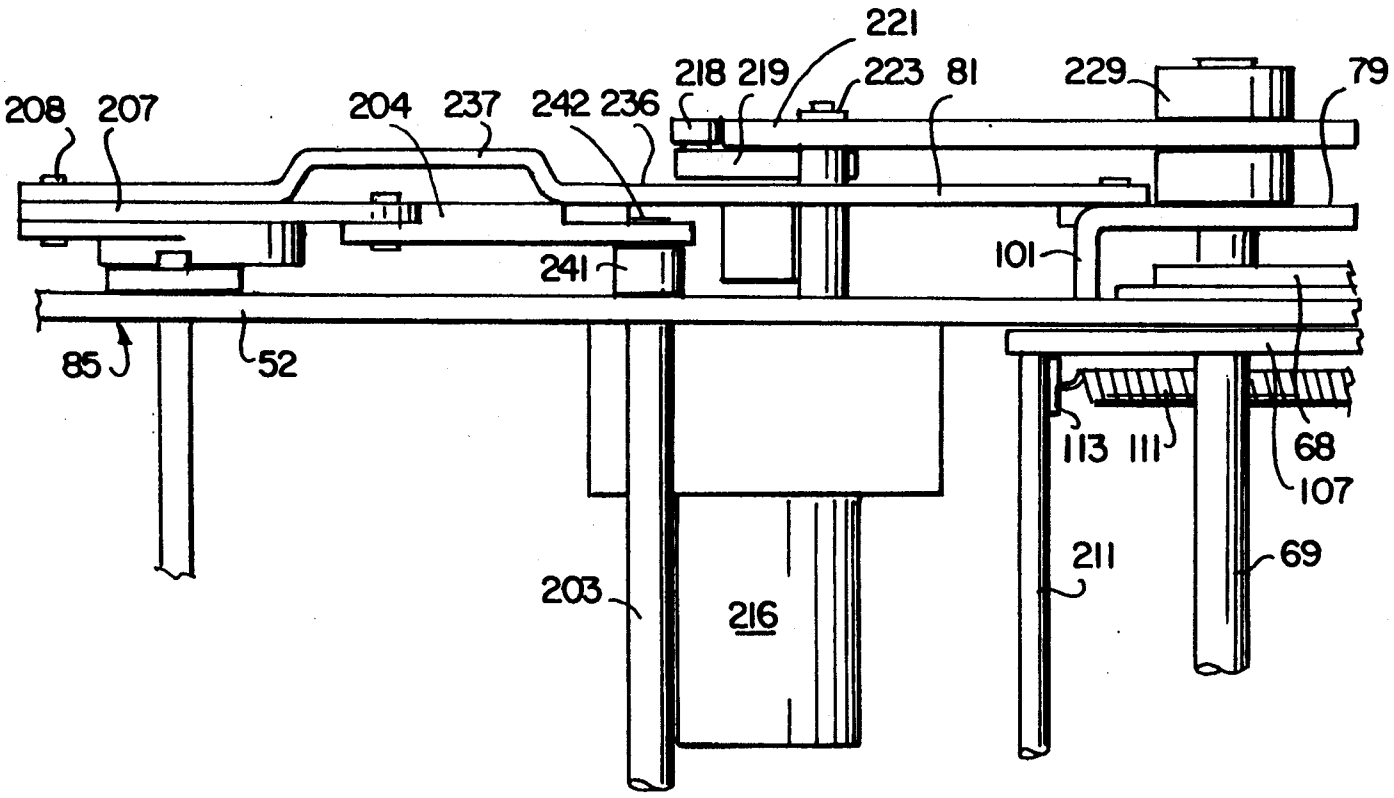
FIG. 14 is an enlarged, fragmentary plan view of a portion of the machine.

Thereupon the operator closes a switch (not shown) which initiates one cycle operation of motor 201. The motor 201 causes links 81 and 236 to move rearwardly from the position of FIGS. 1 and 5 to the position of FIG. 2. The sliding motion of pin 92 in the initial upward-rearwardly slanted portion of slot 88 causes the pawl 91 to engage one of the teeth of ratchet segment 71. Further rotation of the motor causes pawl 91 to push ratchet segments 71 in a further clockwise rotation to move from the dot-and-dash position of FIG. 12 to the position of FIG. 13 until spring 96 compresses as a result of a predetermined pressure of the pressure bar 61 on the stack of sheets 28. Movement of segment 71 in a clockwise direction as viewed in FIG. 14 causes crank arm 68 to move in a clockwise direction, pulling link 67 and pressure bar 61 downwardly, applying a force on the strips 21 and sheets 28 beneath the same. Oscillation of arm 68 oscillates shaft 69 and thus the downward force on each end of pressure bar 61 is equalized.

Lobe 101 moves out of contact with cam surface 109. By the time shaft 203 has turned about 108° motor 201 stops for a time delay during which the binding operation occurs. As lobe 101 moves, springs 111 pull the drive plates 107 to the rear. As soon as plate 107 begins to move to the rear, switch 133 is closed. Since switch 137 is normally closed, a transformer (not shown in this application but shown in U.S. Pat. No. 3,994,035) is energized, heating ribbon 122. A relay is closed for approximately seven seconds.

As ribbon 122 moves from the position of FIG. 8 to the position of FIG. 5, the straight ribbon sections 123 cut off the excess stud material 31, leaving stubs of stud material below the level of the second strip 124. When the support 116 engages abutment 143, switch 137 is opened, causing ribbon 122 to begin to cool. Continued force of springs 111 causes pins 142 to rise in slots 141 and ribbon 122 moves upwardly forming heads on the molten stubs of excess stud material as explained in U.S. Pat. No. 3,994,035. During the timed delay, the cool ribbon 122 draws heat out of the stub material forming a solid head and hardening the same. After forming the heads,motor 201 is re-energized and continued rotation of shaft 203 causes link 81 to move from the position of FIG. 2 to the position of FIG. 1 so that pin 92 rises to the upper end of slot 88. This causes segment 71 to return to the position of FIG. 12. Lobe 101 contacts surface 109, returning support 106 to the initial position of FIG. 8. Motor 201 then stops—its cycle is completed.

Thereupon cam 246 on shaft 203 closes switch 247 thereby energizing return motor 216. As heretofore been explained, this raises link 232 and in turn pressure bar 61 to up position.

To simplify understanding of some of the terms used in the appended claims, but without in any way narrowing the scope of the claims to the specific embodiment herein illustrated and described, it may be considered that the following expressions conform to the reference numerals used, as follows: first crank 68, second crank 79, third crank 204, first link 81, second link 207, third link 221 fourth link 232, first shaft 203, second shaft 69. Actuating means for oscillating third crank 204 may include motor shaft 203, crank cheek 241 and crank pin 242 which fits in slot 243 of crank 204. Means for energizing motor 201 for one cycle includes the conventional manual switch which starts the motor and cam 246 on shaft 203 which contacts switch 247 to stop motor 201.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus used for binding sheets formed at spaced intervals with first apertures using a first strip having a plurality of thermoplastic studs spaced at the same intervals as said first apertures and a second strip formed with second apertures spaced to receive said studs with said sheets between said strips and said studs through said first apertures, comprising: compression means for compressing said strips towards each other comprising a frame, a platen on said frame for supporting said sheets, means for receiving said second strip, a pressure bar extending transversely of said frame and means on said frame formed with guide slots for guiding said pressure bar for movement towards said first strip; a first crank mounted on said frame for oscillatory movement; linkage articulately connecting said first crank and said pressure bar whereby said pressure bar moves toward said first strip as said first crank moves; a second crank pivotally mounted relative to said frame; a third crank pivoted to said frame; actuating means for oscillating said third crank; a first link pivotally interconnecting said third and second cranks; whereby said actuating means causes said third crank to move said first link to oscillate said second crank and said first crank to pull said pressure bar toward said platen, said first link being longitudinally elongated and having forward and rearward ends, said rearward end of said first link being pivoted to said second crank, the improvement comprising:

said actuating means having a motor mounted on said frame with a motor shaft intermediate said forward and rearward ends of said first link, and means for energizing said motor for one rotation of said motor shaft;

a second link;

means connected to said third crank for reciprocating said second link; and means located at said forward end of said first link for articulately connecting said second link to said first link to longitudinally reciprocate said first link;

whereby said motor causes downward movement of said pressure bar to apply pressure to said first strip to compress said sheets between said first and second strip.

2. An apparatus according to claim 1 the improvement which further comprises a ratchet segment oscillatable on said frame and articulately connected to said first link, a pawl pivoted to said first link engageable with said ratchet segment, resilient means interposed between said pawl and said frame, said first link oscillating said ratchet segment to compress said resilient means when said pawl engages said ratchet segment, said resilient means flexing when said first link has applied a predetermined pressure to said first strip and maintaining said predetermined pressure constant as said motor shaft completes a substantial portion of its cycle of rotation and said first link has retracted said pawl from engagement with said ratchet segment.

3. An apparatus according to claim 2, the improvement which further comprises a second shaft extending from side to side of said frame and oscillatable in said frame, means connected to said first link for oscillating said second shaft in a first direction, said ratchet segment being fixed to said second shaft, said first link being connected to said second shaft by a third link which is pivotally connected to said first link.

4. An apparatus according to claim 3 wherein said means for oscillating said second shaft comprises a second motor mounted on said frame, means actuated by said second motor for oscillation said second shaft in a second direction opposite said first direction to return said second shaft to an initial position, and timing means actuated by said first shaft for energizing said second motor after said motor shaft has completed said substantial portion of its cycle of rotation and said pawl has been retracted from said ratchet segment.

5. An apparatus according to claim 4 wherein said third link has a rack and said second shaft has a pinion for engaging said rack.

6. An apparatus according to claim 5 wherein said second motor further comprises an eccentric cam driven by said second motor, said third link being engageable with said eccentric cam.

7. An apparatus according to claim 4 wherein said third link and said first link are mounted on opposite sides of said frame and said second shaft extends transversely across said frame.

8. An apparatus according to claim 1 wherein said third crank is pivoted to said frame at a first end and to said second link at a second end and said third crank is formed with an elongated slot between said ends, and which further comprises an eccentric cam turned by said motor shaft fitting into said elongated slot to pivot said third crank about its said first end and thereby reciprocate said second link.

9. An apparatus according to claim 1 which further comprises a knife, a knife support on which said knife is mounted, knife support guide means on said frame for guiding said knife support, a spring biasing said knife support for movement from a first knife position to a second knife position in which said knife is in a position for cutting off the lengths of said studs beyond said second strip, said knife support having a cam surface, the improvement which further comprises a cam-follower movable between a first actuating position engaging said cam surface to retain said knife support in said first knife position and a second actuating position permitting said spring to move said knife support to second said knife position and later to return said knife support to first knife position.

10. An apparatus according to claim 9 in which said improvement further comprises said knife support having a third knife position in a direction from said second knife position toward said second strip, said knife support guide means being shaped so that said spring moves said knife support to said third knife position to form heads on severed stubs of said studs.

11. An apparatus according to claim 9 the improvement which further comprises a horizontal slot formed in said knife support, a rod fitting in said slot extending transversely across said frame, means connecting said spring to said rod, said slot having a terminus against which said rod bears, said rod partially supporting said knife support.

12. An apparatus according to claim 11 in which said means connecting said spring to said rod comprises an ear fixed to said rod and engaging said knife support to restrain lateral movement of said knife support.

* * * * *